US010591949B2

(12) United States Patent
Nieh et al.

(10) Patent No.: US 10,591,949 B2
(45) Date of Patent: Mar. 17, 2020

(54) TRANSDUCER DEVICE

(71) Applicants: Defond Components Limited, Chai Wan (HK); Defond Electech Co., Ltd., Guangdong (CN)

(72) Inventors: Cheng Chen Nieh, Chai Wan (HK); Hoi Him Ko, Chai Wan (HK)

(73) Assignees: Defond Components Limited, Hong Kong (HK); Defond Electech Co., Ltd. (CN)

( * ) Notice: Subject to any disclaimer, the term of this patent is extended or adjusted under 35 U.S.C. 154(b) by 0 days.

(21) Appl. No.: 16/105,648

(22) Filed: Aug. 20, 2018

(65) Prior Publication Data

US 2019/0086945 A1 Mar. 21, 2019

(30) Foreign Application Priority Data

Sep. 15, 2017 (HK) ..... 17109411.3

(51) Int. Cl.
*G05G 5/06* (2006.01)
*G05G 1/10* (2006.01)
(Continued)

(52) U.S. Cl.
CPC ..... *G05G 5/065* (2013.01); *G05G 1/10* (2013.01); *H01H 19/04* (2013.01); *H01H 19/08* (2013.01);
(Continued)

(58) Field of Classification Search
CPC .. G05G 1/00; G05G 1/08; G05G 1/10; G05G 1/12; G05G 5/03; G05G 5/06;
(Continued)

(56) References Cited

U.S. PATENT DOCUMENTS 3,621,158 A * 11/1971 Swinstead ..... H01H 19/64 200/308
3,902,375 A * 9/1975 Herrick ..... G05G 1/10 74/10.54
2012/0260763 A1* 10/2012 Terao ..... G05G 1/08 74/507

FOREIGN PATENT DOCUMENTS

CN 101752132 A 6/2010
CN 102683078 A 9/2012
(Continued)

*Primary Examiner* — Prasad V Gokhale
(74) *Attorney, Agent, or Firm* — K&L Gates LLP

(57) ABSTRACT

A transducer device including: a base platform; an annular support member mounted on a surface of the base platform, the annular support member having a first opening positioned adjacent the surface of the base platform and a second opening positioned away from the surface of the base platform along a rotation axis; an inner shaft mounted relative to the base platform and configured to extend away from the second opening of the annular support member and rotate relative to the annular support member about the rotation axis; an inner shaft detent mechanism located at least partially within the annular support member configured for releasably securing the inner shaft in a plurality of rotational positions corresponding to each of a plurality of detent positions of the inner shaft detent mechanism as the inner shaft is rotated about the rotation axis; an outer shaft including a passage extending along an elongate axis thereof configured for receiving the inner shaft therein so that the inner shaft and outer shaft are arranged to rotate concentrically relative to each other about the rotation axis, the outer shaft further including a flanged portion configured for seating upon an outer surface of the annular support member; a PCB unit disposed on the surface of the base platform comprising: a first transducer circuit unit operably coupled to the inner shaft and responsive to rotational movement of
(Continued)

the inner shaft about the rotation axis so that the first transducer circuit unit outputs a first electrical signal that is indicative of a rotational position of the inner shaft about the rotational axis; a second transducer circuit unit operably coupled to the outer shaft and responsive to rotational movement of the outer shaft about the rotation axis so that the second transducer circuit unit will output a second electrical signal that is indicative of a rotational position of the outer shaft about the rotational axis; a housing configured for enclosing the first and second transducer circuit units therein and having an opening disposed in a wall of the housing via which ends of the inner and outer shafts may extend outwardly of the housing along the rotation axis; and an outer shaft detent mechanism located between the outer shaft and an inner surface of the housing configured for releasably securing the outer shaft in a plurality of rotational positions corresponding to each of a plurality of detent positions of the outer shaft detent mechanism as the outer shaft is rotated about the rotation axis.

11 Claims, 6 Drawing Sheets

(51) Int. Cl.

| | |
|---|---|
| ***H01H 19/04*** | (2006.01) |
| ***H01H 19/08*** | (2006.01) |
| ***H01H 19/14*** | (2006.01) |
| ***H01H 19/54*** | (2006.01) |
| *G05G 1/08* | (2006.01) |

(52) U.S. Cl.
CPC ..... *H01H 19/14* (2013.01); *H01H 19/54* (2013.01); *G05G 1/08* (2013.01); *G05G 2505/00* (2013.01); *H01H 2019/143* (2013.01); *H01H 2221/07* (2013.01)

(58) Field of Classification Search
CPC .... G05G 5/065; G05G 2505/00; H01H 19/02; H01H 19/04; H01H 19/08; H01H 19/10; H01H 19/11; H01H 19/115; H01H 19/14; H01H 19/54; H01H 2019/143; H01H 2221/07
See application file for complete search history.

(56) References Cited

FOREIGN PATENT DOCUMENTS

| | | |
|---|---|---|
| CN | 104795269 A | 7/2015 |
| TW | 201526059 A | 7/2015 |

* cited by examiner

TRANSDUCER DEVICE

TECHNICAL FIELD

The present invention relates to the field of transducer devices.

BACKGROUND OF THE INVENTION

A transducer is a device that converts one form of energy to another. A common example of the application of a transducer device is a control knob of a home appliance such as a washing machine which may be operable by a user to select a particular wash setting. By turning the control knob, the physical positions of the control knob are converted into electrical signals by a potentiometer or step resistors of the transducer which represent the different positions of the control knob and hence the different selected settings.

In order to provide the user with the flexibility to select a useful range of different operational settings of the home appliance, multiple control knobs are generally mounted on to the home appliance to allow the user to select each different type of operational setting (e.g. wash time, wash temperature, fabric type, drying time etc). However, this is problematic as home appliances have finite space upon which to mount multiple control knobs.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a transducer device including:

a base platform;

an annular support member mounted on a surface of the base platform, the annular support member having a first opening positioned adjacent the surface of the base platform and a second opening positioned away from the surface of the base platform along a rotation axis;

an inner shaft mounted relative to the base platform and configured to extend away from the second opening of the annular support member and rotate relative to the annular support member about the rotation axis;

an inner shaft detent mechanism located at least partially within the annular support member configured for releasably securing the inner shaft in a plurality of rotational positions corresponding to each of a plurality of detent positions of the inner shaft detent mechanism as the inner shaft is rotated about the rotation axis;

an outer shaft including a passage extending along an elongate axis thereof configured for receiving the inner shaft therein so that the inner shaft and outer shaft are arranged to rotate concentrically relative to each other about the rotation axis, the outer shaft further including a flanged portion configured for seating upon an outer surface of the annular support member;

a PCB unit disposed on the surface of the base platform comprising:

a first transducer circuit unit operably coupled to the inner shaft and responsive to rotational movement of the inner shaft about the rotation axis so that the first transducer circuit unit outputs a first electrical signal that is indicative of a rotational position of the inner shaft about the rotational axis;

a second transducer circuit unit operably coupled to the outer shaft and responsive to rotational movement of the outer shaft about the rotation axis so that the second transducer circuit unit will output a second electrical signal that is indicative of a rotational position of the outer shaft about the rotational axis;

a housing configured for enclosing the first and second transducer circuit units therein and having an opening disposed in a wall of the housing via which ends of the inner and outer shafts may extend outwardly of the housing along the rotation axis; and an outer shaft detent mechanism located between the outer shaft and an inner surface of the housing configured for releasably securing the outer shaft in a plurality of rotational positions corresponding to each of a plurality of detent positions of the outer shaft detent mechanism as the outer shaft is rotated about the rotation axis.

Preferably, the annular support element may be fixed to the base platform.

Preferably, the present invention may include an inner shaft locking mechanism for selectably locking the inner shaft in at least one of a locked and an unlocked configuration wherein when arranged in the locked configuration the inner shaft is restricted from rotating about the rotation axis, and when arranged in the unlocked configuration, the inner shaft is able to rotate about the rotation axis.

Preferably, the inner shaft locking mechanism may be disposed between the inner shaft and the surface of the base platform, whereby the inner shaft is arranged in the locked position by first displacing the inner shaft in a direction axially along the rotation axis towards the surface of the base platform and then rotating the inner shaft about the rotation axis into a predetermined rotational position.

Preferably, the first transducer circuit unit may include a first potentiometer (or step resistor element) and the second transducer circuit unit may include a second potentiometer (or step resistor element), each of said first and second potentiometers having conductive wipers operably coupled to the inner and outer shafts respectively so as to rotate with the inner and outer shafts about the rotation axis, and corresponding potentiometer wiper plates mounted on the surface of the base platform, whereby the first electrical signal and the second electrical signal that are output by the transducer device may be generated by reference to the relative positions of the conductive wipers and corresponding wiper plates of the first and second potentiometers.

Preferably, the annular support member may be mounted on the surface of the base platform whereby a wall of the annual support member is configured to electrically and/or physically separate the wiper plates of the first potentiometer from those of the second potentiometer.

Preferably, the inner shaft detent mechanism may include a spring-loaded protrusion configured to extend radially outwardly from the inner shaft for engagement in the plurality of detent positions located around the inner surface of the annular support member as the inner shaft is rotated about the rotation axis, whereby the inner shaft may be releasably secured in the plurality of rotational positions corresponding to each of a plurality of detent positions as the inner shaft engages in each of the plurality detent positions.

Preferably, the spring-loaded protrusion of the inner shaft detent mechanism may include a spring-loaded ball bearing adjacent an outer surface of the inner shaft.

Preferably, the outer shaft detent mechanism may include a spring-loaded protrusion configured to extend from an inner surface of the housing for engagement in the plurality of detent positions located around an outer surface of the outer shaft as the outer shaft is rotated about the rotation axis, whereby the outer shaft may be releasably secured in the plurality of rotational positions corresponding to each of a plurality of detent positions as the outer shaft engages in each of the plurality detent positions.

Preferably, the spring-loaded protrusion may extend from the inner surface of the housing towards the outer surface of the outer shaft in a direction substantially aligned with the rotation axis.

Preferably, the spring-loaded protrusion of the outer shaft detent mechanism may include a spring-loaded ball bearing that is seated in a recess formed in the inner surface of the housing.

Preferably, at least one of the outer shaft and the housing are formed by injection molding.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Figure 1:
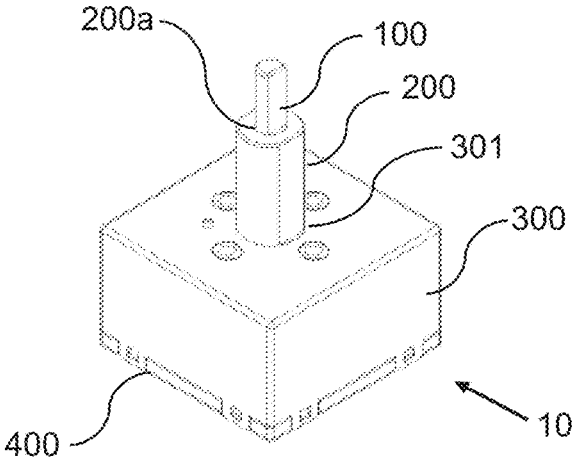
FIG. 1 shows a perspective view of a transducer device having concentric first and second transducer shafts in accordance with an embodiment of the present invention.
Figure 2:
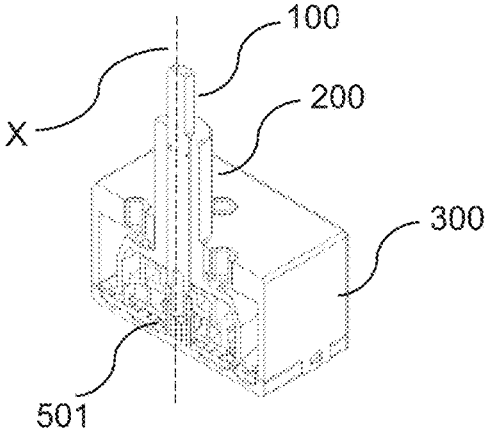
FIG. 2 shows a perspective cut-away view of the transducer device having concentric first and second transducer shafts in accordance with an embodiment of the present invention.
Figure 3:
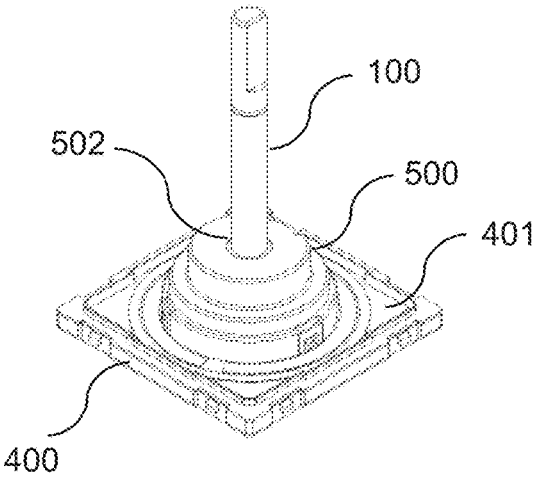
FIG. 3 shows a perspective view of the base platform, an annular support member fixed to the base platform, and an inner shaft rotatably coupled to the base platform so as so extend away from the base platform through an opening in the annular support member, in accordance with an embodiment of the present invention.

Preferred embodiments of the present invention will now be described herein with reference to FIGS. 1 to 13B.

In a first embodiment, a transducer device (10) is provided having a base platform (400) with a printed circuit board (800) assembly (PCB) disposed on a surface (401) of the base platform (400). An annular support member (500) is securely fixed relative to the surface (401) of the base platform (400) by means of snap-fitting engagement with the base platform (400). Both the base platform (400) and the annular support member (500) may be injection molded such that engagement tabs may for instance be molded in to the annular support member (500) which are configured for snap-fitting engagement with corresponding notches molded in to the base platform (400) or vice versa. The annular support member (500) includes a first opening (501) located adjacent the surface of the base platform (400) and a second opening (502) located relatively away from the surface (401) of the base platform (400) along a rotation axis (X).

An inner shaft (100) extends substantially perpendicularly away from the surface (401) of the base platform (400) through the second opening (502) of the annular support member (500) along the rotation axis (X). The inner shaft (100) is configured for rotational movement about the rotation axis (X) whereby the second opening (502) in the annular support member (500) assists in guiding rotational movement of the inner shaft (100). The second opening (502) in the annular support member (500) is suitably shaped and dimensioned such that it serves as a guide for movement of the inner shaft (100) extending therethrough.

The inner shaft (100) is able to be selectably locked and unlocked from rotational operation about the rotation axis (X). This may be accomplished by any number of mechanisms however by way of example a decoupler member (101) is employed for the purpose, the operation of which is described as follows. The decoupler member (101) is fixed to the inner shaft (100) as shown and configured to follow movement of the inner shaft (100) both axially and rotationally at all times. The decoupler member (101) is also fixed to a region of the inner shaft (100) so as to be enclosed between the annular support member (500) and the surface (401) of the base platform (400). An axial spring (103) is configured for urging the inner shaft (100) linearly along the rotational axis (X) in a direction perpendicularly away from the surface (401) of the base platform (400). Accordingly, when the inner shaft (100) is arranged in the locked position, the inner shaft (100) and decoupler member (101) fixed to the inner shaft (100) will be urged perpendicularly away from the surface (401) of the base platform (400) in a direction linearly along the rotation axis (X) and in to engagement with an internal shape contour of the annular support member (500). By virtue of the engagement of the decoupler member (101) with the internal shape contour of the annual support member (500), rotational movement of the inner shaft (100) is thereby restricted. In this embodiment, the inner shaft (100) may be moved into an unlocked position from the locked position whereby it is free to rotate about the rotation axis (X) by depressing the inner shaft (100) against the axial spring (103) in a direction linearly along the rotation axis (X) towards the surface (401) of the base platform (400) and then rotating the depressed inner shaft (100) about the rotation axis (X) into a predetermined rotational position whereby the decoupler member (101) fixed to the inner shaft (100) disengages from the internal shape contour of the annular support member (500). When the inner shaft (100) is arranged in the unlocked position it is free to rotate without undergoing any further axial displacement. To return the inner shaft (100) to the locked position, the inner shaft (100) is rotated back to the predetermined rotational position before depressing the inner shaft (100) against the axial spring (103) in a direction towards the surface (401) of the base platform (400).

An inner shaft detent mechanism (700,701,702) is located between the annular support member (500) and the surface (401) of the base platform (400) and is configured for releasably securing the inner shaft (100) in any one of a plurality of rotational positions corresponding to each of a plurality of detent positions of the inner shaft detent mechanism as the inner shaft (100) is rotated about the rotation axis (X). The positions of the inner shaft detents are disposed circumferentially in spaced apart fashion around an inner surface of a sidewall of the annular support member (500). A spring-loaded protrusion (700) (e.g. a spring-loaded steel ball-bearing) and a compression spring (701), which biases movement of the spring-loaded protrusion (700) in along a direction radially outwardly from the inner shaft (100), are located in a guide recess (702) of an inner disc (900) disposed between the annular support member (500) and the surface (401) of the base platform (400). As the inner shaft (100) is rotated about the rotation axis (X), the spring-loaded protrusion (700) moves linearly along the radial axis with compression and expansion of the compression spring (701) within the guide recess (702) so as to progressively engage with each of the detents disposed around the inner surface of the annular support member (500). In this way, the inner shaft detent mechanism allows the inner shaft (100) to be releasably secured in the plurality of rotational positions corresponding to each of the plurality of detent positions.

An outer shaft (200) is also provided which includes a cylindrical-shaped passage (200*a*) extending along an elongate axis thereof. The outer shaft (200) is suitably shaped and dimensioned for receiving a portion of the inner shaft (100) therein so that the inner shaft (100) and outer shaft (200) are arranged to rotate concentrically relative to each other about the rotation axis (X). The outer shaft (200) also includes a flanged portion (201) relatively proximate to the base platform (400) which is configured for seating upon an outer surface of the annular support member (500). Rotational movement of the outer shaft (200) about the rotation axis (X) is guided by both the annular support member (500) upon which the flanged portion of the outer shaft (200) is seated as well as an opening (301) disposed in a housing member (300) through which an end of the outer shaft (200) protrudes. The housing member (300) is attached to the base platform (400) by snap-fit engagement so as to enclose components of the transducer device (10) therein.

An outer shaft detent mechanism is located between the outer shaft (200) and an inner surface (302) of the housing member (300) that encloses the flanged portion of the outer shaft (200). The outer shaft detent mechanism is configured for releasably securing the outer shaft (200) in any one of a plurality of rotational positions corresponding to each of a plurality of detent positions (202) of the outer shaft detent mechanism as the outer shaft (200) is rotated about the rotation axis (X). In particular, a plurality of outer shaft detents (202) are disposed circumferentially in spaced apart fashion around the flanged portion (201) of the outer shaft (200). The outer shaft detents (202) may typically be integrally molded into the structure of the outer shaft (200) for ease of production and assembly of the transducer device (10). A spring-loaded protrusion (304) (e.g. a spring-loaded protrusion) and a compression spring (306), which biases movement of the spring-loaded protrusion (304) along an axis extending substantially in a direction aligned with the rotation axis (X), are seated in a recess (305) molded in to an inner surface (302) of the housing member (300). The recess (305) is shaped and dimensioned to assist in guiding linear movement of the compression spring (306) and spring-loaded protrusion (304) in the direction aligned with the rotation axis (X). The spring-loaded protrusion (304) and compression spring (306) are configured such that the spring-loaded protrusion (304) moves linearly with compression and expansion of the compression spring (306) so as to progressively engage with each of the detents (202) disposed around the flanged portion (201) of the outer shaft (200) as the outer shaft (200) is progressively rotated about the rotation axis (X). In this way, the spring biased movement of the spring-loaded protrusion (304) in to engagement with each of the detent positions (202) enables releasable securement of the outer shaft (200) in each of the plurality of rotational positions corresponding to each of the plurality of outer shaft detent positions (202). Conveniently, the guidance provided to the spring-loaded protrusion (304) and compression spring (306) by the guide recess (305) disposed in the inner surface (302) of the housing member (300) maximises the spring-loaded protrusion (304) travel limit (307) such that switching torque may be optimised during rotations of the outer shaft (200).

The PCB (800) disposed on the surface (401) of the base platform (400) comprises a first transducer circuit that is operably coupled to the inner shaft (100) and which is responsive to rotational movement of the inner shaft (100) about the rotation axis (X) so that the first transducer circuit outputs a variable first electrical signal that is indicative of a rotational position of the inner shaft (100) about the rotational axis (X). In this embodiment, the first transducer circuit includes a first potentiometer (800*a*) having a conductive wiper (901) operably coupled to the inner shaft (100) so as to rotate with the inner shaft (100) about the rotation axis (X). Corresponding wiper plates (801) of the first potentiometer (800*a*) are disposed on the PCB (800) of the base platform (400). As the inner shaft (100) is rotated about the rotation axis (X), the relative contact position of the conductive wiper (901) disposed on the inner disc (900) with the corresponding wiper plates (801) will also change. In this embodiment the inner disc (900) is disposed between the decoupler element (101) and the PCB (800) and is configured to follow the rotational movement of the decoupler element (101). Rotational and axial movement of the inner disc (900) is guided by the internal shape contour of the annular support member (500). The conductive wiper (901) of the first potentiometer is mounted on a surface of the inner disc (900) which faces the surface (401) of the base platform (400) so that as the inner disc (900) is rotated, the conductive wiper (901) will variably contact with the corresponding wiper plates (801) of the first potentiometer disposed on the PCB (800). In use, the conductive wiper (901) is configured to have current running therethrough such that the first potentiometer will output a variable first electrical signal (e.g. variable voltage signal) in response to the relative contact position of the conductive wiper (901) with the corresponding wiper plates (801). Accordingly, it is possible to represent any given rotational position of the inner shaft relative to the rotation axis corresponding to inner shaft detent positions by reference to the variable first electrical signal that is output by the first potentiometer.

The PCB (800) disposed on the surface (401) of the base platform (400) also comprises a second transducer circuit unit that is operably coupled to the outer shaft (200) and which is responsive to rotational movement of the outer shaft (200) about the rotation axis (X) so that the second transducer circuit outputs a variable second electrical signal that is indicative of a rotational position of the outer shaft (200) about the rotation axis (X). In this embodiment, the second transducer circuit (800*b*) includes a second potentiometer (800*b*) having a conductive wiper (204) operably coupled to a surface of an outermost flanged portion (203) of the outer shaft (200) so as to rotate with the outer shaft (200) about the rotation axis (X). Corresponding wiper plates (802) of the second potentiometer (800*b*) are disposed on the PCB (800) of the base platform (400). As the outer shaft (200) is rotated about the rotation axis (X), the relative contact position of the conductive wiper (204) with the corresponding wiper plates (802) will also change. In use, the conductive wiper (204) is configured to have current running therethrough such that the second potentiometer (800*b*) will output a variable second electrical signal (e.g. variable voltage signal) in response to the relative contact position of the conductive wiper (204) with the corresponding wiper plates (802). Accordingly, the second potentiometer is able to represent any one of the rotational positions of the outer shaft (200) relative to the rotation axis (X) as the spring-loaded protrusion (304) is releasably secured in each of the outer shaft detent positions (202), by reference to the variable second electrical signal that is output by the second potentiometer.

In this embodiment, the annular support member (500) is fixed to the surface (401) of the base platform (400) in such a way that a sidewall of the annular support member (500) electrically separates the wiper plates (801) of the first potentiometer from the wiper plates (802) of the second potentiometer on the PCB (800). That is, the wiper plates (801) of the first potentiometer are located between the annular support member (500) and the PCB (800) on the surface (401) of the base platform (400) whilst the wiper plates (802) of the second potentiometer are located between the sidewall of the annular support member (500) and the housing (300).

Figure 4:
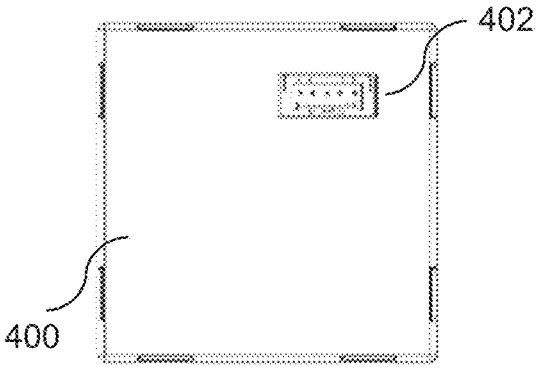
FIG. 4 shows a bottom view of the transducer device with an electrical connector unit shown disposed on the base platform that may be configured for electrical communication of data and power signals from the transducer device to an external system.
Figure 5:
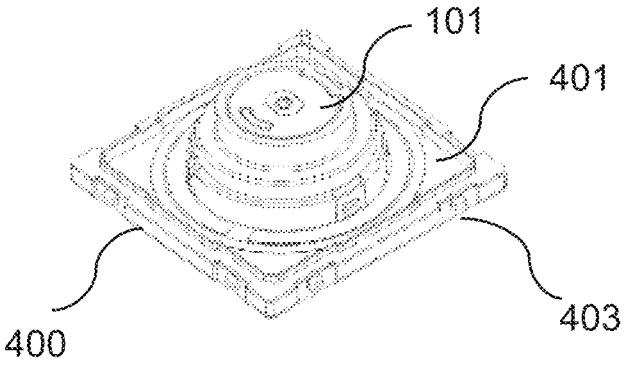
FIG. 5 shows a perspective view of the base platform and the annular support member fixed thereon with a top surface of the annular support member removed so as to reveal an inner shaft decoupler element arranged in a locked position whereby rotational movement of the inner shaft is restricted, in accordance with an embodiment of the present invention.
Figure 6:
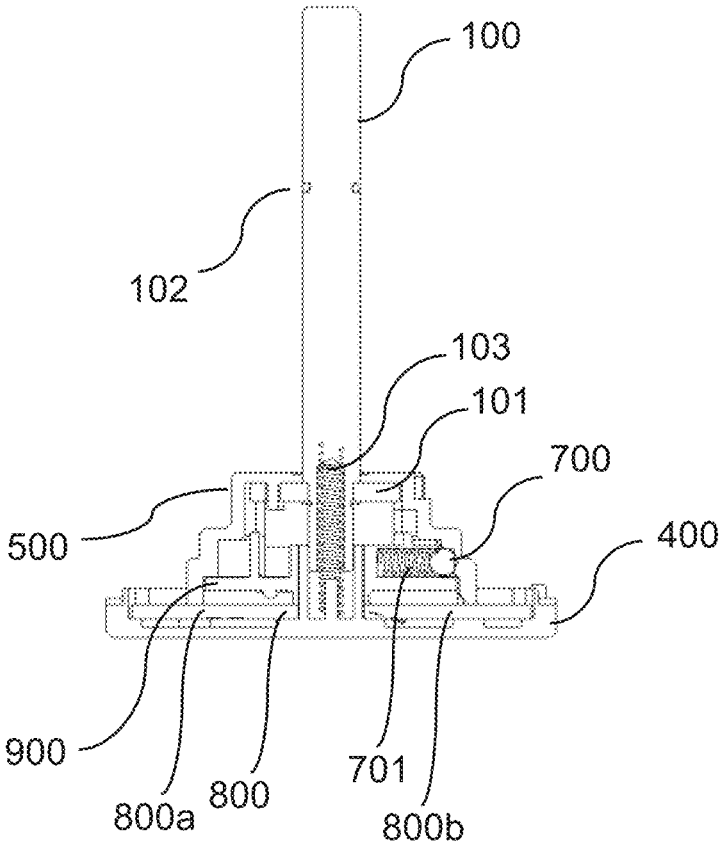
FIG. 6 shows a side cut-away view of the transducer device with the housing member removed and the inner shaft and decoupler element shown urged in to a locked position by the axial spring whereby the inner shaft is restricted from rotational movement, in accordance with an embodiment of the present invention.
Figure 7:
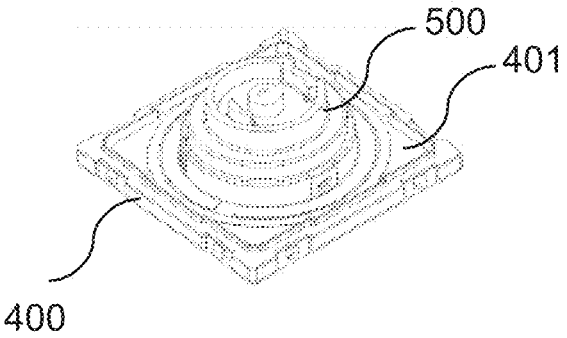
FIG. 7 shows a perspective view of the base platform and the annular support member fixed thereon with a top surface of the annular support member transparent so as to reveal an inner shaft decoupler element arranged in an unlocked position whereby rotational movement of the inner shaft is restricted, in accordance with an embodiment of the present invention.
Figure 8:
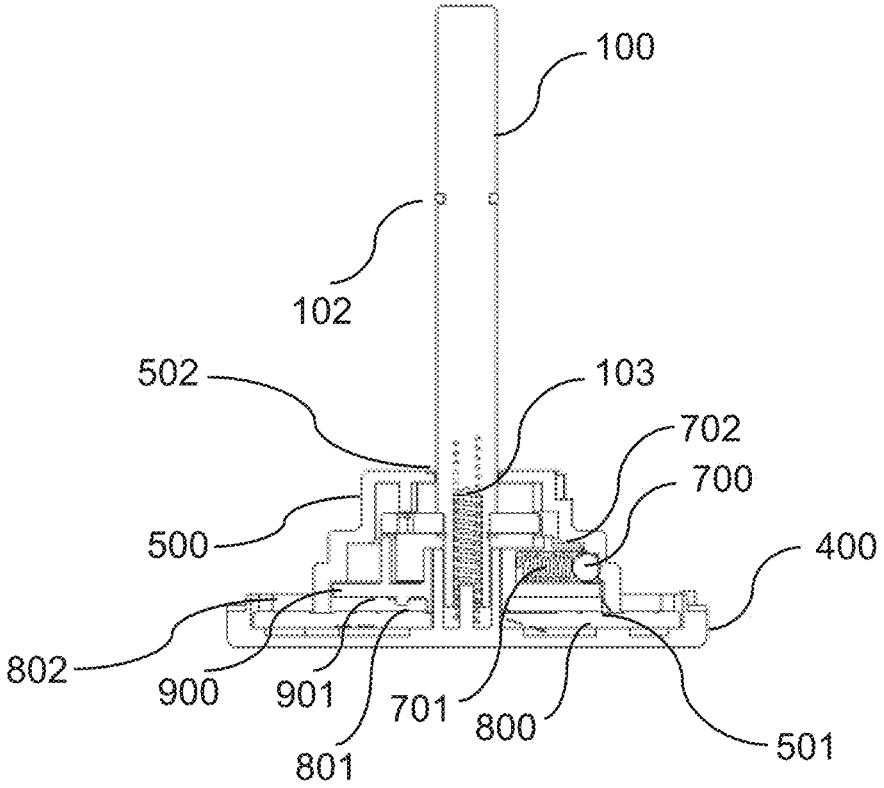
FIG. 8 shows a side cut-away view of the transducer device with the housing member removed and the inner shaft and decoupler element arranged in the unlocked position whereby the inner shaft is free to rotate about the rotation axis, in accordance with an embodiment of the present invention.
Figure 9:
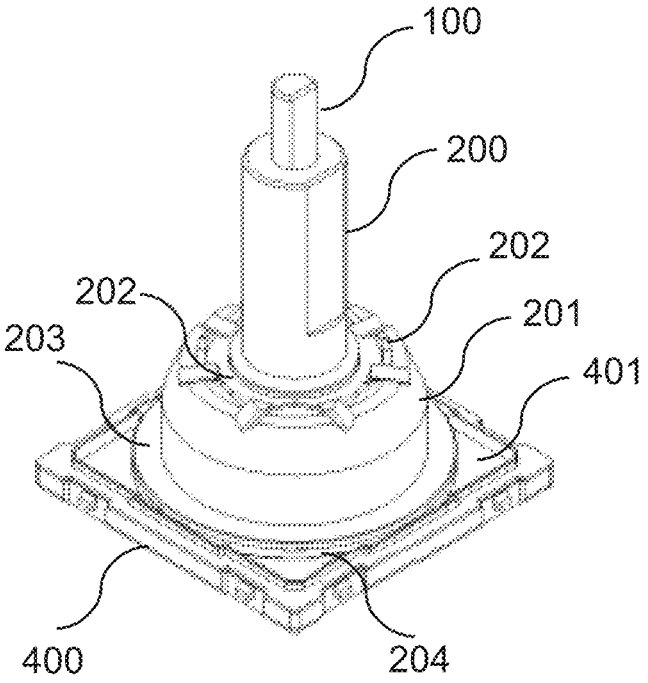
FIG. 9 shows a perspective view of the base platform, the inner shaft and an outer shaft with a flanged portion of the outer shaft seated upon the annular support member, the flanged portion of the outer shaft having integrally molded detent portions disposed thereon, in accordance with an embodiment of the present invention.
Figure 10:
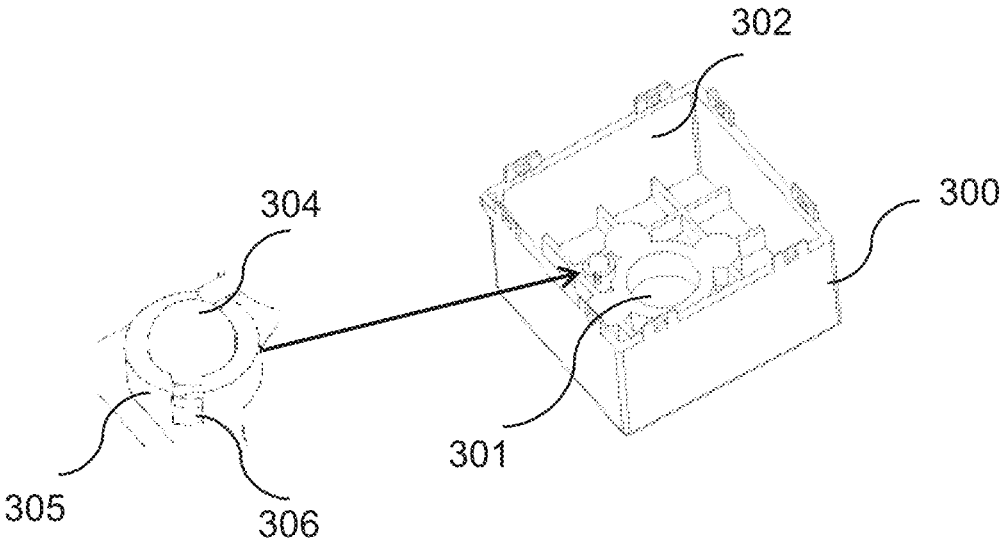
FIG. 10 shows a perspective view of a housing member configured for snap-fit attachment with the base platform to enclose components of the transducer device, the inner surface of the housing member including a spring-loaded steel ball seated within a guide-recess configured for engagement with the detent portions disposed on the flanged portion of the outer shaft, in accordance with an embodiment of the present invention.
Figure 11:
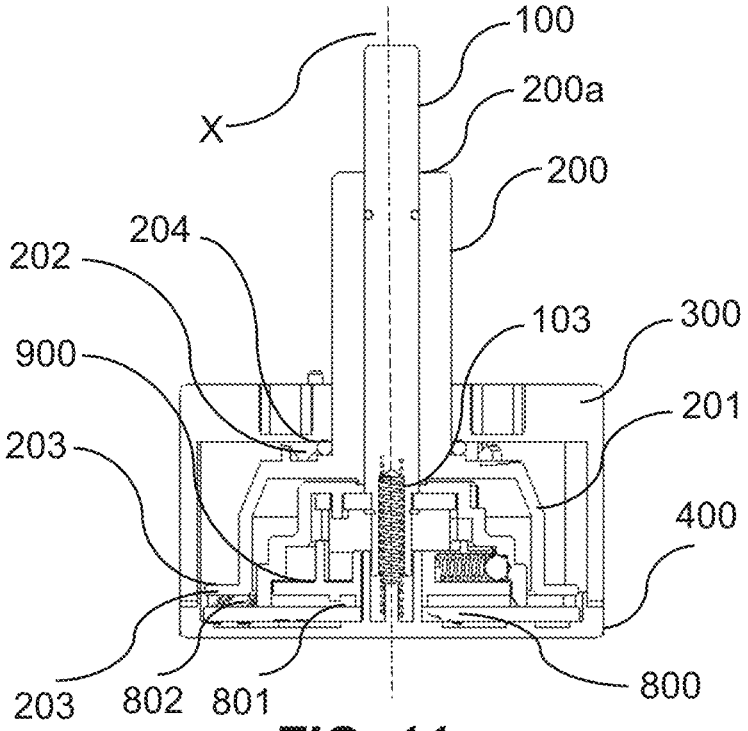
FIG. 11 shows one side cut-away view of the transducer device with the housing member attached to the base platform so as to enclose components therebetween and with the spring-loaded steel ball seated within the guide recess of the inner surface of the housing member shown engaging with detent portions of the outer flange of the outer shaft, in accordance with an embodiment of the present invention.
Figure 12:
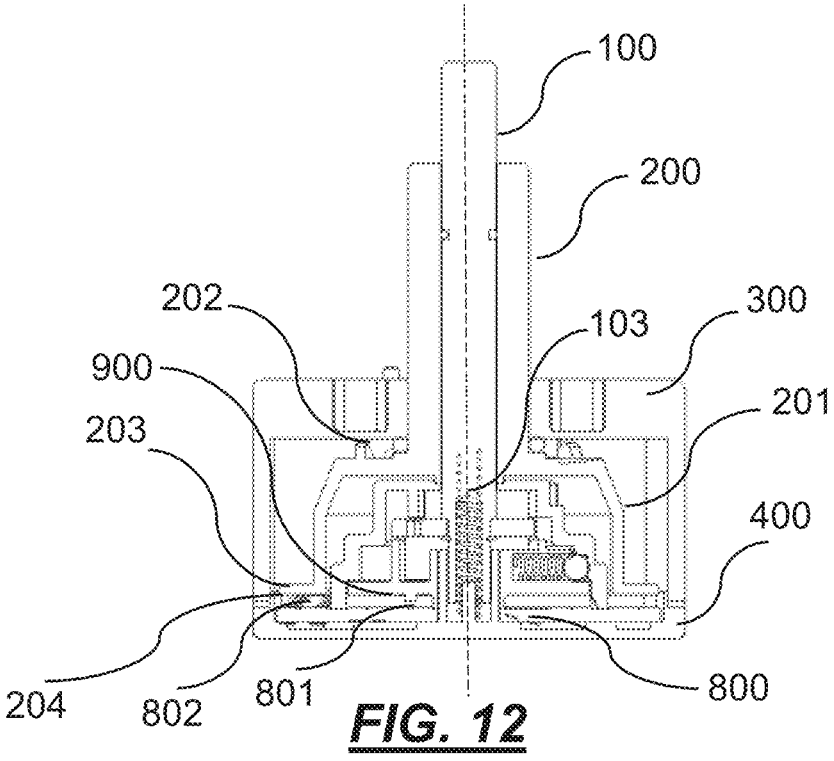
FIG. 12 shows another side cut-away view of the transducer device with the housing member attached to the base platform so as to enclose components therebetween and with the spring-loaded steel ball seated within the guide recess of the inner surface of the housing member shown engaging with detent portions of the outer flange of the outer shaft, in accordance with an embodiment of the present invention.
Figure 13A:
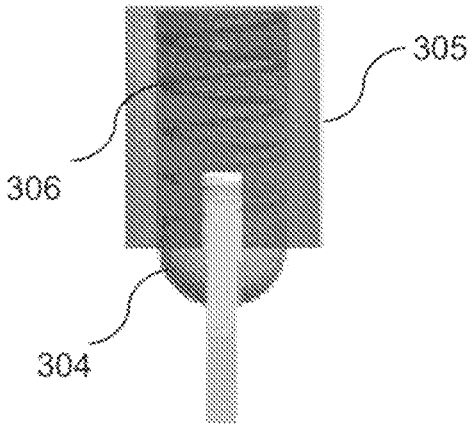
FIGS. 13A and 13B show the spring-loaded steel ball seated with the guide recess of the inner surface of the housing member in an extended position (when the compression spring is expanded) and a retracted position (when the compression spring is contracted), respectively.
Figure 13B:
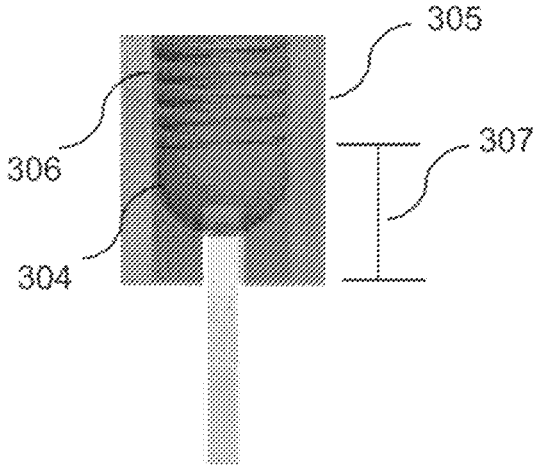

As shown in FIG. 4, the transducer device includes an electrical connector unit (402) disposed on an outer-facing surface of the base platform (400) that is configured for electrical communication of data and power signals from the transducer device (10) to an external system.

To effect suitable sealing, a first O-ring (102) is provided for sealing a gap between the outer surface of the inner shaft (100) and an inner surface of the outer shaft (200), and, a second O-ring (204) is also provided for sealing a gap between the outer surface of the outer shaft (200) and the inner surface (302) of the housing member (300) as shown.

In view of the above, it will be apparent that embodiments of the present invention herein described may assist in providing at least one of the following advantages:

(a) dual transducer functionality is provided within a single relatively compact transducer device by utilisation of a concentric transducer shaft configuration. Such embodiments of the present invention may be useful for implementation as a control knob of a home appliance such as a washing machine where the compact control knob may, for example, be utilised to control multiple control settings such as wash temperature control and wash time control;

(b) turning torque optimisation of a transducer shaft may be improved as the transducer shaft rotates amongst detents by utilisation of the detent engagement mechanism having a spring-biased steel ball within a recess configured to maximise steel ball travel limit;

(c) relative ease and cost-effectiveness of production and assembly of embodiments of the present invention by virtue of the components parts (e.g. housing, base platform, outer shaft, inner shaft, annular support member etc.) being producible by use of conventional injection molding equipment and techniques; and (d) a single PCB may be easily and cost-effectively fabricated using existing equipment and techniques for dual-use with both transducer circuits of the transducer device, whilst the wiper plates of the first and second transducer circuits are conveniently separated physical and electrically by the sidewall of the annular support member.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A transducer device including:

a base platform;

an annular support member mounted on a surface of the base platform, the annular support member having a first opening positioned adjacent the surface of the base platform and a second opening positioned away from the surface of the base platform along a rotation axis;

an inner shaft mounted relative to the base platform and configured to extend away from the second opening of the annular support member and rotate relative to the annular support member about the rotation axis;

an inner shaft detent mechanism located at least partially within the annular support member configured for releasably securing the inner shaft in a plurality of rotational positions corresponding to each of a plurality of detent positions of the inner shaft detent mechanism as the inner shaft is rotated about the rotation axis;

an outer shaft including a passage extending along an elongate axis thereof configured for receiving the inner shaft therein so that the inner shaft and outer shaft are arranged to rotate concentrically relative to each other about the rotation axis, the outer shaft further including a flanged portion configured for seating upon an outer surface of the annular support member;

a PCB unit disposed on the surface of the base platform comprising:

a first transducer circuit unit operably coupled to the inner shaft and responsive to rotational movement of the inner shaft about the rotation axis so that the first transducer circuit unit outputs a first electrical signal that is indicative of a rotational position of the inner shaft about the rotational axis; and a second transducer circuit unit operably coupled to the outer shaft and responsive to rotational movement of the outer shaft about the rotation axis so that the second transducer circuit unit will output a second electrical signal that is indicative of a rotational position of the outer shaft about the rotational axis;

a housing configured for enclosing the first and second transducer circuit units therein and having an opening disposed in a wall of the housing via which ends of the inner and outer shafts may extend outwardly of the housing along the rotation axis; and an outer shaft detent mechanism located between the outer shaft and an inner surface of the housing configured for releasably securing the outer shaft in a plurality of rotational positions corresponding to each of a plurality of detent positions of the outer shaft detent mechanism as the outer shaft is rotated about the rotation axis.

2. A transducer device as claimed in claim 1 wherein the annular support element is fixed to the base platform.

3. A transducer device as claimed in claim 1 including an inner shaft locking mechanism for selectably locking the inner shaft in at least one of a locked and an unlocked configuration wherein when arranged in the locked configuration the inner shaft is restricted from rotating about the rotation axis, and when arranged in the unlocked configuration, the inner shaft is able to rotate about the rotation axis.

4. A transducer device as claimed in claim 1 wherein the inner shaft locking mechanism is disposed between the inner shaft and the surface of the base platform, whereby the inner shaft is arranged in the locked position by first displacing the inner shaft in a direction axially along the rotation axis towards the surface of the base platform and then rotating the inner shaft about the rotation axis into a predetermined rotational position.

5. A transducer device as claimed in claim 1 wherein the first transducer circuit unit includes a first potentiometer and the second transducer circuit unit includes a second potentiometer, each of said first and second potentiometers having wiper elements operably coupled to the inner and outer shafts respectively so as to rotate with the inner and outer shafts about the rotation axis, and corresponding wiper plates mounted on the surface of the base platform, whereby the first electrical signal and the second electrical signal that are output by the transducer device are generated by reference to the relative positions of the wiper elements and corresponding wiper plates of the first and second potentiometers.

6. A transducer device as claimed in claim 5 wherein the annular support member is mounted on the surface of the base platform whereby a wall of the annual annular support member is configured to physically separate the wiper plates of the first potentiometer from those of the second potentiometer.

7. A transducer device as claimed in claim 1 wherein the inner shaft detent mechanism includes a spring-loaded protrusion configured to extend radially outwardly from the inner shaft for engagement in the plurality of detent positions located around the inner surface of the annular support member as the inner shaft is rotated about the rotation axis, whereby the inner shaft may be releasably secured in the plurality of rotational positions corresponding to each of a plurality of detent positions as the inner shaft engages in each of the plurality detent positions.

8. A transducer device as claimed in claim 1 wherein the outer shaft detent mechanism includes a spring-loaded protrusion configured to extend from an inner surface of the housing for engagement in the plurality of detent positions located around an outer surface of the outer shaft as the outer shaft is rotated about the rotation axis, whereby the outer shaft may be releasably secured in the plurality of rotational positions corresponding to each of a plurality of detent positions as the outer shaft engages in each of the plurality detent positions.

9. A transducer device as claimed in claim 8 wherein the spring-loaded protrusion extends from the inner surface of the housing towards the outer surface of the outer shaft in a direction substantially aligned with the rotation axis.

10. A transducer device as claimed in claim 8 wherein the spring-loaded protrusion of the outer shaft detent mechanism includes a spring-loaded ball bearing protrusion that is seated in a recess formed in the inner surface of the housing.

11. A transducer device as claimed in claim 1 wherein at least one of the outer shaft and the housing are formed by injection molding.

* * * * *